US010018343B2

(12) United States Patent
Wasserman et al.

(10) Patent No.: US 10,018,343 B2
(45) Date of Patent: Jul. 10, 2018

(54) MODULAR LIGHT SYSTEM

(71) Applicant: NUM LIGHTING LTD., Tel Aviv (IL)

(72) Inventors: Nurit Wasserman, Tel Aviv (IL); Imanuel Wasserman, Tel Aviv (IL); Uri Zaidman, Kadima (IL)

(73) Assignee: NUM LIGHTING LTD., Tel Aviv (IL)

( * ) Notice: Subject to any disclaimer, the term of this patent is extended or adjusted under 35 U.S.C. 154(b) by 89 days.

(21) Appl. No.: 14/410,382

(22) PCT Filed: Jun. 23, 2013

(86) PCT No.: PCT/IL2013/050534
§ 371 (c)(1),
(2) Date: Dec. 22, 2014

(87) PCT Pub. No.: WO2014/002085
PCT Pub. Date: Jan. 3, 2014

(65) Prior Publication Data

US 2015/0167948 A1 Jun. 18, 2015

Related U.S. Application Data

(60) Provisional application No. 61/664,341, filed on Jun. 26, 2012.

(51) Int. Cl.
*F21V 17/00* (2006.01)
*F21V 23/06* (2006.01)
(Continued)

(52) U.S. Cl.
CPC ..... *F21V 23/06* (2013.01); *F21S 2/005* (2013.01); *F21S 8/03* (2013.01); *F21V 19/003* (2013.01);
(Continued)

(58) Field of Classification Search
CPC ..... F21V 21/14; F21V 15/01; F21V 219/001; F21V 23/06; F21S 2/005; F21S 8/03; F21S 8/032
(Continued)

(56) References Cited

U.S. PATENT DOCUMENTS

D362,512 S 9/1995 Specht
5,640,069 A 6/1997 Nilssen
(Continued)

FOREIGN PATENT DOCUMENTS

CN 200943299 Y 9/2007
CN 201047512 Y 4/2008
(Continued)

*Primary Examiner* — Sean Gramling
*Assistant Examiner* — Gerald J Sufleta, II
(74) *Attorney, Agent, or Firm* — Vorys, Sater, Seymour & Pease LLP

(57) ABSTRACT

Provided is a light tile including a light-source bed having a rear face and a front face configured for accommodating at least one light source; and a base unit having a rear face and a front face. The base unit includes an electric unit and an interconnecting arrangement for interconnecting the base unit with a base unit of at least one other light tile. The base unit is configured for interfacing with the light-source bed so as to establish mechanical connection therebetween, and the electric unit is configured to be electrically connected with the light-source bed so as to establish electric communication therebetween and to provide electric power to the at least one light source.

16 Claims, 7 Drawing Sheets

(51) Int. Cl.

| | |
|---|---|
| ***F21S 2/00*** | (2016.01) |
| ***F21V 19/00*** | (2006.01) |
| ***F21V 21/096*** | (2006.01) |
| ***F21V 23/04*** | (2006.01) |
| ***F21S 8/00*** | (2006.01) |
| ***F21V 21/088*** | (2006.01) |
| *F21V 3/00* | (2015.01) |
| *F21V 17/16* | (2006.01) |
| *F21Y 105/10* | (2016.01) |
| *F21Y 115/10* | (2016.01) |

(52) U.S. Cl.
CPC ..... *F21V 21/088* (2013.01); *F21V 21/096* (2013.01); *F21V 23/0435* (2013.01); *F21V 3/00* (2013.01); *F21V 17/164* (2013.01); *F21Y 2105/10* (2016.08); *F21Y 2115/10* (2016.08)

(58) Field of Classification Search
USPC ..... 362/236, 249.12, 249.13
See application file for complete search history.

(56) References Cited

U.S. PATENT DOCUMENTS

| | | | | |
|---|---|---|---|---|
| 7,358,929 | B2 | 4/2008 | Mueller et al. | |
| D585,847 | S | 2/2009 | Roberts et al. | |
| D632,007 | S | 2/2011 | Kim et al. | |
| D632,008 | S | 2/2011 | Kim et al. | |
| 2001/0024368 | A1* | 9/2001 | Henrici | F21S 2/005 362/235 |
| 2002/0141181 | A1 | 10/2002 | Bailey | |
| 2003/0193789 | A1* | 10/2003 | Karlicek, Jr. | H01R 29/00 361/760 |
| 2004/0031219 | A1 | 2/2004 | Banister | |
| 2004/0240230 | A1 | 12/2004 | Kitajima et al. | |
| 2005/0007780 | A1 | 1/2005 | Feuerborn et al. | |
| 2005/0060949 | A1 | 3/2005 | McNaught | |
| 2005/0116667 | A1 | 6/2005 | Mueller et al. | |
| 2005/0130502 | A1 | 6/2005 | Scalfi | |
| 2005/0168984 | A1 | 8/2005 | Ossevoort et al. | |
| 2005/0178034 | A1* | 8/2005 | Schubert | G09F 9/33 40/605 |
| 2005/0201087 | A1 | 9/2005 | Ward | |
| 2005/0219860 | A1 | 10/2005 | Schexnaider | |
| 2005/0248935 | A1* | 11/2005 | Strip | G06F 1/1601 362/145 |
| 2005/0265051 | A1 | 12/2005 | Yamamoto et al. | |
| 2006/0044215 | A1 | 3/2006 | Brody et al. | |
| 2006/0285361 | A1 | 12/2006 | Cok | |
| 2006/0289201 | A1 | 12/2006 | Kim et al. | |
| 2007/0133193 | A1 | 6/2007 | Kim | |
| 2008/0002399 | A1 | 1/2008 | Villard et al. | |
| 2008/0019121 | A1 | 1/2008 | Ly | |
| 2008/0036397 | A1* | 2/2008 | Hockel | F21S 2/005 315/294 |
| 2008/0037284 | A1 | 2/2008 | Rudisill | |
| 2008/0087464 | A1 | 4/2008 | Patterson et al. | |
| 2008/0101094 | A1 | 5/2008 | Spada et al. | |
| 2008/0111470 | A1 | 5/2008 | Yuan et al. | |
| 2008/0137336 | A1 | 6/2008 | Choi et al. | |
| 2008/0205078 | A1 | 8/2008 | Karlicek et al. | |
| 2008/0244944 | A1* | 10/2008 | Nall | G09F 13/04 40/544 |
| 2008/0297072 | A1 | 12/2008 | Snijder et al. | |
| 2009/0009997 | A1* | 1/2009 | Sanfilippo | F21S 2/005 362/244 |
| 2009/0034241 | A1 | 2/2009 | Coushaine et al. | |
| 2009/0086487 | A1* | 4/2009 | Ruud | F21S 2/005 362/249.02 |
| 2009/0097242 | A1 | 4/2009 | Hsieh et al. | |
| 2009/0116235 | A1 | 5/2009 | Tsao et al. | |
| 2009/0116241 | A1 | 5/2009 | Ashoff et al. | |
| 2009/0129088 | A1 | 5/2009 | Custodis | |
| 2009/0129115 | A1 | 5/2009 | Fine et al. | |
| 2009/0146910 | A1 | 6/2009 | Gardner | |
| 2009/0147504 | A1 | 6/2009 | Teeters | |
| 2009/0213590 | A1 | 8/2009 | Gardenier et al. | |
| 2009/0237936 | A1 | 9/2009 | Ku | |
| 2009/0284978 | A1 | 11/2009 | Elliott et al. | |
| 2009/0309494 | A1 | 12/2009 | Patterson et al. | |
| 2009/0322251 | A1 | 12/2009 | Hilgers | |
| 2010/0027257 | A1 | 2/2010 | Boonekamp et al. | |
| 2010/0052866 | A1 | 3/2010 | Elferich et al. | |
| 2010/0109567 | A1 | 5/2010 | Deurenberg et al. | |
| 2010/0142198 | A1 | 6/2010 | Yang | |
| 2010/0165627 | A1 | 7/2010 | Wung et al. | |
| 2010/0170702 | A1 | 7/2010 | Boss et al. | |
| 2010/0188846 | A1 | 7/2010 | Oda et al. | |
| 2010/0244692 | A1 | 9/2010 | Van Endert | |
| 2010/0245109 | A1 | 9/2010 | Ashoff et al. | |
| 2010/0284173 | A1 | 11/2010 | Verjans et al. | |
| 2011/0013390 | A1 | 1/2011 | Biebel et al. | |
| 2012/0098451 | A1 | 4/2012 | Okawa et al. | |
| 2013/0113392 | A1* | 5/2013 | Chen | F21V 33/006 315/294 |
| 2013/0163234 | A1* | 6/2013 | Hsien | F21S 2/005 362/190 |
| 2013/0294078 | A1* | 11/2013 | Tsao | F21V 17/005 362/249.02 |

FOREIGN PATENT DOCUMENTS

| | | | |
|---|---|---|---|
| DE | 30 14 241 | A1 | 11/1981 |
| DE | 101 48 582 | A1 | 4/2003 |
| DE | 20 2004 006 389 | U1 | 7/2004 |
| DE | 20 2004 007 881 | U1 | 8/2004 |
| DE | 10 2005 002 783 | A1 | 8/2005 |
| DE | 20 2006 005 428 | U1 | 6/2006 |
| DE | 20 2007 003 973 | U1 | 6/2007 |
| DE | 10 2006 014 800 | A1 | 10/2007 |
| DE | 10 2008 026 169 | A1 | 12/2009 |
| DE | 10 2008 056 958 | A1 | 5/2010 |
| DE | 10 2009 017 162 | A1 | 10/2010 |
| DE | 20 2010 001 888 | U1 | 11/2010 |
| EP | 0 469 179 | A1 | 2/1992 |
| EP | 1 162 400 | A2 | 12/2001 |
| EP | 1 365 376 | A1 | 11/2003 |
| EP | 1 519 106 | A2 | 3/2005 |
| EP | 1 586 810 | A2 | 10/2005 |
| EP | 1 818 598 | A2 | 8/2007 |
| EP | 1 862 725 | A2 | 12/2007 |
| EP | 1 980 785 | A1 | 10/2008 |
| EP | 2 055 849 | A1 | 5/2009 |
| EP | 2 116 986 | A2 | 11/2009 |
| EP | 2 157 357 | A1 | 2/2010 |
| EP | 2 163 701 | A1 | 3/2010 |
| EP | 2 184 535 | A1 | 5/2010 |
| EP | 2 256 720 | A1 | 12/2010 |
| EP | 2 257 127 | A1 | 12/2010 |
| EP | 2 434 211 | A2 | 3/2012 |
| FR | 2 635 849 | A1 | 3/1990 |
| FR | 2 932 873 | A1 | 12/2009 |
| GB | 2 438 636 | A | 12/2007 |
| GB | 2 442 977 | A | 4/2008 |
| IT | BS950103 | U1 | 5/1997 |
| KR | 10-2010-0024281 | A | 3/2010 |
| KR | 10-2011-0046854 | A | 5/2011 |
| TW | 201007065 | A1 | 2/2010 |
| TW | 201105165 | A1 | 2/2011 |
| TW | 201108174 | A1 | 3/2011 |
| WO | 01/52222 | A1 | 7/2001 |
| WO | 2006/098727 | A1 | 9/2006 |
| WO | 2007/037712 | A1 | 4/2007 |
| WO | 2007/042547 | A1 | 4/2007 |
| WO | 2007/122113 | A1 | 11/2007 |
| WO | 2009/012914 | A1 | 1/2009 |
| WO | 2009/020298 | A2 | 2/2009 |
| WO | 2009/069076 | A2 | 6/2009 |
| WO | 2009/072386 | A1 | 6/2009 |
| WO | 2010/046815 | A1 | 4/2010 |
| WO | 2010/128440 | A1 | 11/2010 |
| WO | 2011/047104 | A1 | 4/2011 |

(56) References Cited

FOREIGN PATENT DOCUMENTS

| | | | |
|---|---|---|---|
| WO | 2011/058486 | A2 | 5/2011 |
| WO | 2011/069842 | A1 | 6/2011 |
| WO | 2012/073543 | A1 | 6/2012 |

* cited by examiner

MODULAR LIGHT SYSTEM

FIELD OF THE DISCLOSED SUBJECT MATTER

The present disclosed subject matter is concerned with a modular light system.

BACKGROUND

Modular light systems can be used in different areas, which include home lighting, general lighting, under-cabinet lighting, illuminated tiled walls, industrial lighting, task lighting, architectural lighting and varied general decorative lighting applications. The modular lighting systems can allow customizable sizes, shapes, colors, and textures, with low profile, and low power consumption.

The use of internal lighting in tiles that can be combined or arranged into modular light systems has been constrained by technological limitations. For example, older systems had to rely on light sources of limited lifetime, making it impractical for light tiles to be permanently installed into buildings and/or walkways. Newer technologies, such as solid state lighting systems (e.g., light emitting diodes), present new opportunities to integrate internal lighting into light tiles in practical and durable ways. The added durability can permit the use of modular light systems for safety and/or decorative purposes. These newer technologies provide simple controlling, use of thin tiles and low power operation.

SUMMARY OF THE DISCLOSED SUBJECT MATTER

The presently disclosed subject matter, in accordance with one aspect, provides a light tile that comprises:

a light-source bed having a rear face and a front face configured for accommodating at least one light source; and a base unit having a rear face and a front face, and comprising an electric unit and an interconnecting arrangement for interconnecting the base unit with a base unit of at least one another light tile; the base unit being configured for interfacing with the light-source bed so as to establish mechanical connection therebetween, and the electric unit is configured to be electrically connected with the light-source bed so as to establish electric communication therebetween and to provide electric power to said at least one light source.

The presently disclosed subject matter, in accordance with another aspect, provides a modular light system comprising a plurality of light tiles. Each of the light tiles comprises:

a light-source bed having a rear face and a front face configured for accommodating at least one light source; and a base unit having a rear face and a front face, and comprising an electric unit and an interconnecting arrangement for interconnecting the base unit with a base unit of at least one another light tile of said plurality of light tiles, so as to form an array of base units; the base unit being configured for interfacing with the light-source bed so as to establish mechanical connection therebetween, and the electric unit is configured to be electrically connected with the light-source bed so as to establish electric communication therebetween and to provide electric power to the at least one light source.

According to a particular example, the light tiles of the modular system can include more than one light-source bed mountable on a base unit. These light-source beds can be disposed in proximity to each other.

According to another example, the light tiles of the modular system can include more than one base unit on which one light-source bed is mountable. These base units can be disposed in proximity to each other.

According to another example, each of the light tiles of the modular system can have a size different from at least one of its neighboring light tiles. According to a particular example, the light tile can have a modularly increasing size so that each light tile has a neighboring light tile with a double size than its size.

The modular light system allows adding and removing light tiles by connecting and disconnecting their base units to and from each other, thereby defining the amount of light tiles forming the array of base units. This array can have a shape and a size according to various design and illumination needs.

The modular light system allows using the array of base units for mounting thereon different corresponding light source beds according to various requirements and needs, and replacing the light source beds of the modular light system according to these requirements and needs, whilst keeping the structure of the array. The replacement of a light-source bed of a particular tile can be performed without to need to replace the corresponding base unit.

The ability to define the amount of base units forming the array, and the ability to mount different light source beds on each of the base units and replace them according the various needs, provide the modular light system with freedom and flexibility to form various light structures according to different design and performance needs.

The term 'electric communication' refers hereinafter to electric and/or electronic connectivity between electric and/or electronic components.

Any one or more of the following features, qualities and designs, can be applied, independently or jointly, and applied respectively to any one or more of the aspects of the presently disclosed subject matter:

The light tile can further comprise a cover configured to extend along the front face of the light-source bed for at least partially covering said at least one light source. The cover can be used for concealing and/or protecting the light source(s) of the light-source bed and for decorative and/or functional purposes. The cover can have different types of structure and design. For example, the cover can be engraved, patterned, colored, transparent, semi-transparent, opaque, etc.

The base unit and the light-source bed can be detachebly attachable or fixedly mountable to each other. The cover and the light-source bed can be detachebly attachable or fixedly mountable to each other. The cover can also be can be detachebly attachable or fixedly mountable to the base unit while the light-source bed is fixedly disposed therebetween. The cover can also be provided as an integral part of the light-source bed.

According to a particular example, one cover can be used for a plurality of light tiles. This cover can extend along the front face the light-source beds of these light tiles.

The front face of the base unit can be configured for interfacing with the rear face of the light-source bed.

The base unit can comprise at least one base unit mechanical connector and the light-source bed can comprise at least one corresponding bed mechanical connector configured to be mechanically connected with the at least one base unit mechanical connector so as to establish the mechanical connection between the base unit and the light-source bed. The base unit mechanical connector can be disposed at the front face of the base unit, and the bed mechanical connector can be disposed at the rear face of the light-source bed.

The base unit mechanical connector and the bed mechanical connector can be magnetic elements configured for magnetically attracting to each other.

The base unit mechanical connector can be a snapping element and the bed mechanical connector can be a corresponding receiving element configured to engage with the snapping element.

The electric unit can comprise a base unit electric connector and the light-source bed comprises a corresponding bed electric connector configured to be electrically connected with the base unit electric connector so as to establish the electric communication between the base unit and the light-source bed to provide electric power to the at least one light source.

The base unit electric connector(s) and the bed electric connector(s) can comprise at least one spring contact probe or a flat spring connector. One type of a spring contact probe can be a so called Pogo™ pin connector. Alternatively, the base unit electric connector(s) and the bed electric connector (s) can comprise blad or receptacle connectors.

The base unit electric connector(s) and the bed electric connector(s) can also comprise at least one of the following: at least one blade connector, at least one receptacle connector and at least one insertion connector.

Alternatively, the base unit electric connector(s) and the bed electric connector(s) can be electric connectors configured to be manually connected to each other. Each of the electric connectors can be connected with a wire to its respective part of the light tile.

The electric communication between the base unit electric connector and the bed electric connector can be automatically provided upon establishment of the mechanical connection between the base unit and the light-source bed According to one example, the electric unit can comprise a power supply, and a power source connector configured for connecting the power supply with an external power source, for supplying power to the electric unit. According to this example, each base unit can have its own power supply and the array of base units can include an unlimited number of base units, according to desired patterns and various illumination requirements.

The electric unit can alternatively or additionally include an internal power source (e.g., an electric battery) which is configured for providing power to the electric unit.

The electric unit can additionally comprise at least one joining power connector for connecting the electric unit with an electric unit of said base unit of said at least one another light tile, so as to provide and share power supply therebetween.

The configuration of the modular light system can be such that an electric unit of one light tile is connectable to an external power source, and the rest of the system's light tiles are electrically connected to this light tile and receive power supply therethrough. The electric connection between the light tile can be performed via the joining power connectors of the tiles.

The electric unit can comprise an internal controller responsible for controlling the operation of the at least one light source.

Alternatively, the internal controller can be disposed within the light-source bed for controlling the operation of the at least one light source. In particular, this internal controller can be disposed within the rear face of the light-source bed.

The internal controller can further be configured for controlling the operation of at least one light source of the base unit of the another light tile.

The internal controller can comprise an IR receiver or a wireless receiver (e.g., bluetooth, RF, etc.) configured to communicate with an IR transmitter or a wireless transmitter, respectively, for receiving operational instructions therefrom. The wireless transmitter can be a cellular phone.

The electric unit can comprise a controller connector configured for connecting the electric unit with an external controller responsible for controlling the operation of the at least one light source.

The external and/or the internal controller can be configured for controlling one or more light sources of one or more light-source beds for providing different lightening effects.

The electric unit can have two controller connectors: one controller connector for connecting the electric unit of one light tile with an external controller, and another controller connector for connecting the electric unit with a corresponding controller connector of another light tile, so as to allow the external controller to control both electric units.

The internal controller can be controlled and operated by different controlling means such as: a photo-sensitive cell, a remote control, "smart phone" applications, voice activation, and a "smart home" system.

According to a particular example, the internal controller can comprise an IR receiver configured to communicate with an IR transmitter for receiving operational instructions therefrom.

The interconnecting arrangement of a base unit, used for interconnecting between neighboring base units, can be disposed at a peripheral portion thereof.

The base unit further can comprise a mounting arrangement configured for mounting the rear face of the base unit to a supporting element.

When the array of base units is assembled, one or more of the base units of the array can be used for mounting the array of base units to the supporting element (via their mounting arrangements), while the base units that are not connected to the supporting element are connected to the whole array by their interconnecting arrangements.

An array of base unit having a plurality of base units being interconnected therebetween via interconnecting arrangements can be mounted to a supporting element by a using a minimal number of base units which are connected to the supporting element. This minimal number can be, for example, two base units connected to the supporting element, while the rest of the base units are connected to this base unit via the interconnecting arrangements thereof.

The base units of the array can be articulated to one another to form a partition wall, and the like.

The base units of the array can be modularly connected to each other such that a brick-like configuration of base units is formed. According to this configuration, each base unit can be shifted in half-length with respect to its neighboring base unit.

In the particular example of a rectangular unit, the base units forming the array of base units can be rotated in 90°, 180° and 270° with respect to each other for forming various decorative configurations. However, when using polygonal shapes respective rotation of the units can be applied to any one or more of the units, to obtain a required ornamental pattern.

In addition, according to a particular example, the light-source beds and/or the covers of the modular light system can be rotated in 90°, 180° and 270° with respect to each other for forming various decorative configurations.

The light source can be a light emitting diode (LED), so that each light-source bed can include an array of LEDs. The light-source bed can comprise different types of light sources.

The light-source bed can comprise a printed circuit board (PCB) on which the at least one light source is disposed. Alternatively, the at least one light source can be detachably attachable light elements such as replaceable LEDs or other light sources.

The light tile can have a rectangular, a polygonal, an oval shape, or any other geometrical shape.

The light-source bed can include various light sources which can be arranged according to predetermined arrangement patterns. These light sources can be provided in various types, each characterized by a predetermined shape and color, and with a predetermined electric power. A light-source bed having one arrangement pattern and type of light sources can be replaced with another light-source bed having other arrangement pattern and type of light sources.

BRIEF DESCRIPTION OF THE DRAWINGS

In order to understand the disclosed subject matter and to see how it may be carried out in practice, embodiments will now be described, by way of non-limiting examples only, with reference to the accompanying drawings, in which.

DETAILED DESCRIPTION OF EMBODIMENTS

Figure 1:
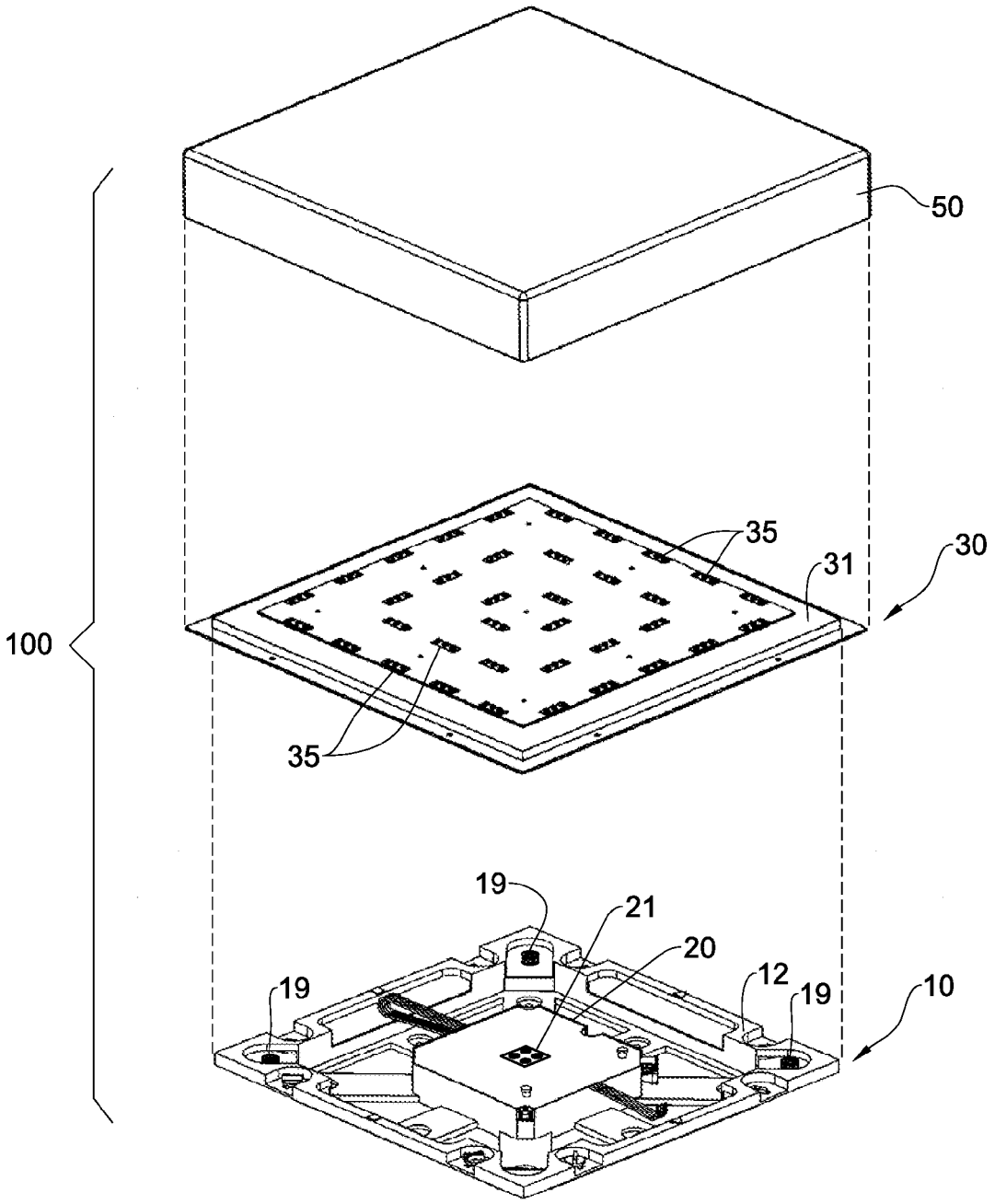
FIG. 1 illustrates an exploded prospective view of a light tile according to one example of the presently disclosed subject matter.

The presently disclosed subject matter is directed to a modular light tile having a light-source bed with a particular design and lightening characteristics. The presently disclosed subject matter is further directed to a plurality of light tiles forming a modular light system. The modular light system allow adding and removing light tiles, and replacing the light source beds of particular tiles without disassembling the whole system and without fully replacing particular light tiles.

Attention is first directed to FIGS. 1 to 4 of the drawings, which schematically illustrate a light tile 100 (shown in FIG. 1) and components thereof, according to one example of the presently disclosed subject matter. The light tile 100 comprises with a base unit 10 configured with a front face 12 and a rear face 14, and a light-source bed 30 having a front face 31 and a rear face 33.

The base unit 10 includes an electric unit 20 mounted thereon. The electric unit 20 is responsible for providing and controlling electric power of the light tile 100, and communicating with other light tiles of the modular light system. The light-source bed 30 comprises a plurality of light sources 35 mounted on the front face 31. The electric unit 20 includes electric components which are responsible for providing electric power to the light tile 100, and particularly to the light sources 35, when mounted to the base unit 10.

The light sources 35 are an array of light-emitting diodes (LED) which are arranged according to a predetermined pattern. According to different examples, the light sources 35 can be of various types, and each type can be characterized by a predetermined shape and color, and with a predetermined electric power. The light sources 35 are electrically interconnected therebetween in the light-source bed 30 by wiring disposed on a PCB.

The light-source bed 30 is formed in shape and size to be interfaced with the base unit 10, so as to establish mechanical connection and electric communication therebetween. In particular, the front face 12 of the base unit 10 is configured for mechanically interfacing with the rear face 33 of the light-source bed 30 so as to establish the mechanical connection therebetween, and the electric unit 20 is configured to be electrically connected with the light-source bed 30 so as to establish electric communication therebetween and to provide electric power to the light sources 35.

The separation between the base unit 10 and the light-source bed 30 provides the flexibility of the light tile 100 to replace one light-source bed with another light-source bed, without replacing the base unit 10 or the entire light tile. The replacement of the light-source bed 30 can be required for different reasons such as: changing the exterior design of the light tile, replacing the light sources 35 of the light tile, etc.

Figure 3A:
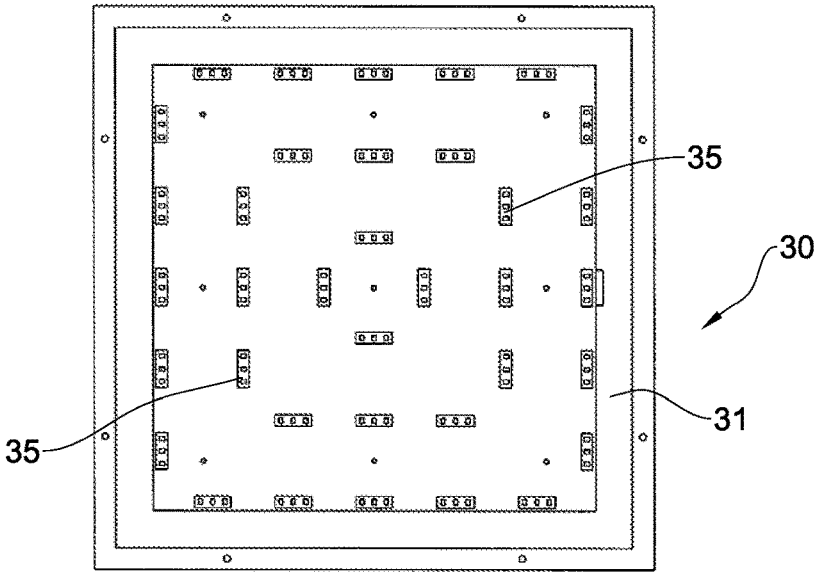
FIG. 3A illustrates a schematic front view of a light-source bed of the light tile shown in FIG. 1.
Figure 3B:
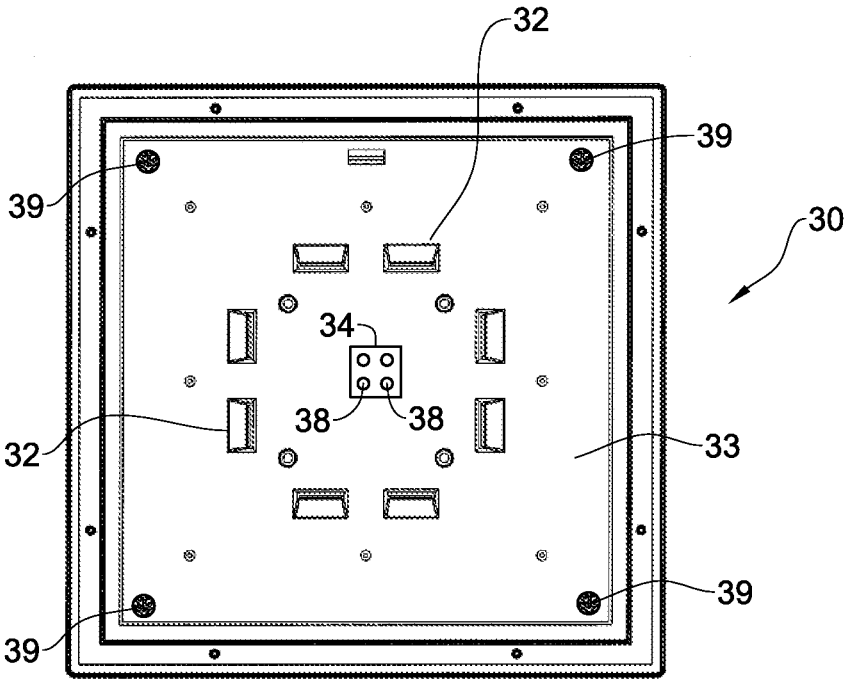
FIG. 3B illustrates a schematic rear view of the light-source bed shown in FIG. 3A.
Figure 4:
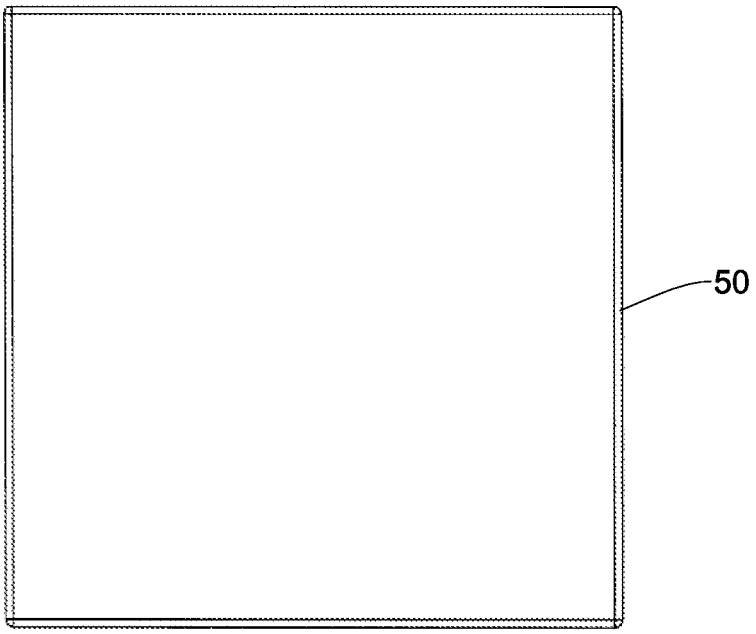
FIG. 4 illustrates a schematic front view of a cover configured to extend along the front face of the light-source bed of FIGS. 3A and 3B.

The base unit 10 has base unit mechanical connectors in form of first magnetic elements 19, and the light-source bed 30 has bed mechanical connectors in form of second magnetic elements 39 (shown in FIG. 3B). The first magnetic elements 19 are configured for magnetically attaching to the second magnetic elements 39, so as to establish the mechanical connection between the base unit 10 and the light-source bed 30.

In addition, as shown in FIG. 3B, the light-source bed 30 has additional bed mechanical connectors in the form of snapping elements 32. The snapping elements 32 are configured for snapping a side wall 23 of a covering 22 of the electric unit 20. The side wall 23 constitutes an additional base unit mechanical connector. The mechanical interaction between the snapping elements 32 and the covering 22 also establishes the mechanical connection between the base unit 10 and the light-source bed 30.

The electric unit 20 comprises a base unit electric connector 21 having spring contact probes 24 disposed therein. The light-source bed 30 comprises a bed electric connector 34 having electric sockets 38. The spring contact probes 24 are configured to be received within the electric sockets 38 so as to establish the electric communication between the base unit 10 and the light-source bed 30 in order to provide electric power to the light sources 35. According to the present example, the spring contact probes 24 are Pogo™ pin connectors. In addition, according to the present example, a voltage of 12-24 Volt can be supplied by the electric unit 20 to the light-source bed 30 and the light sources 35 for their operation.

Upon mounting the light-source bed 30 on the base unit 10 and mechanically interconnecting therebetween, the electric connection between the light-source bed 30 and the base unit 10, and particularly between the spring contact probes 24 and the electric sockets 38, is established automatically.

Figure 5:
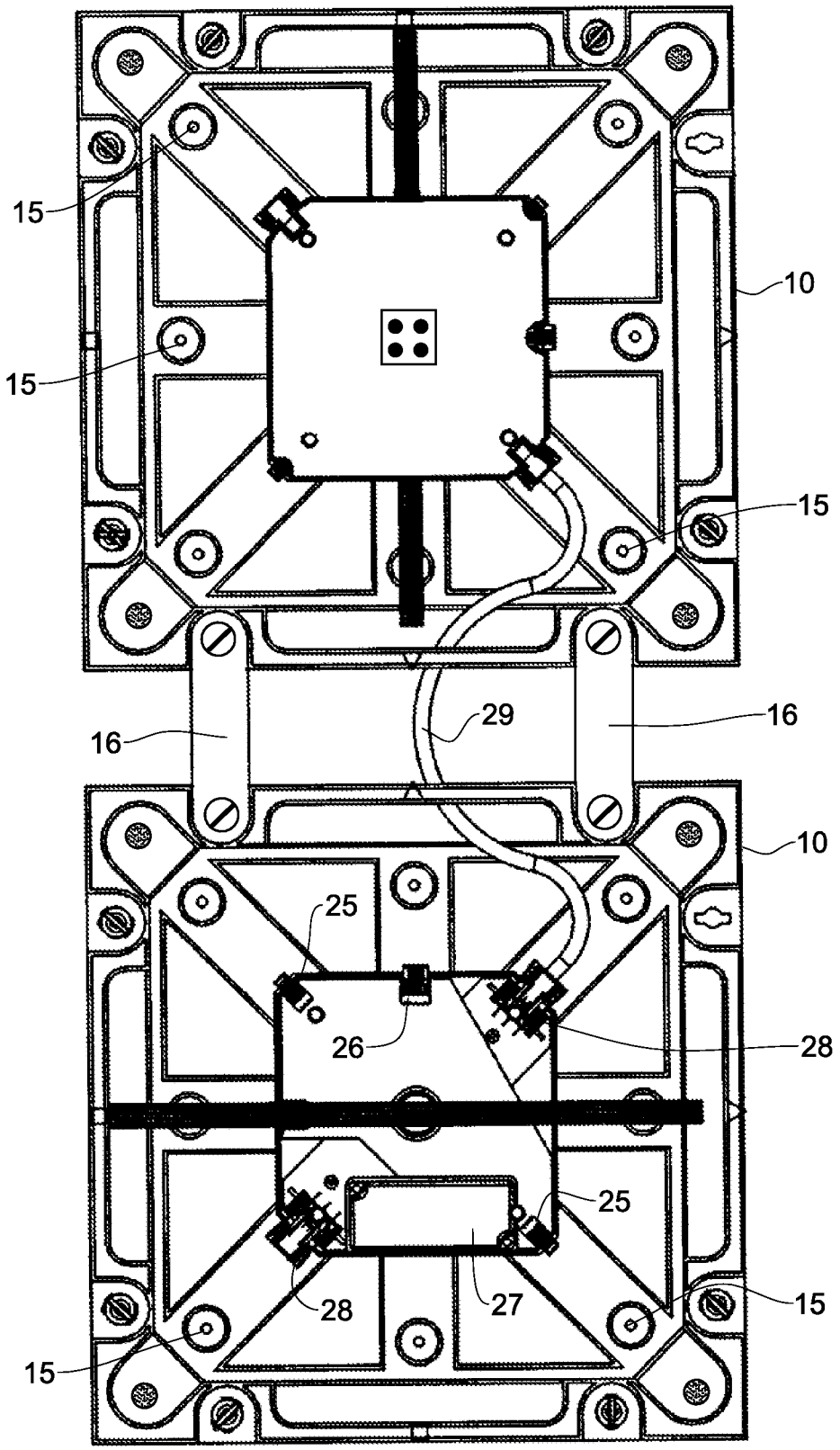
FIG. 5 illustrates an a schematic front view of two base units of FIG. 1, being mechanically and electrically interconnected therebetween.

Reference is now additionally made to FIG. 5, in which two base units of two different light tiles are illustrated. These two base units are connected therebetween by an interconnecting arrangement which consists of connectors 16 and holes 17 (shown in FIG. 2A) formed within each base unit 10. The connectors 16 are connectable to the base units 10 by screw means. As shown in the above figures, due to the rectangular shape of the base unit 10, it can be connected to a maximum of four other base units.

Due to the fact that each edge of the base unit has two symmetrically spaced holes 17, the base units can be connected to each other according to a brick-like configuration according to which each base unit is shifted in half-length with respect to its neighboring base unit.

Figure 2A:
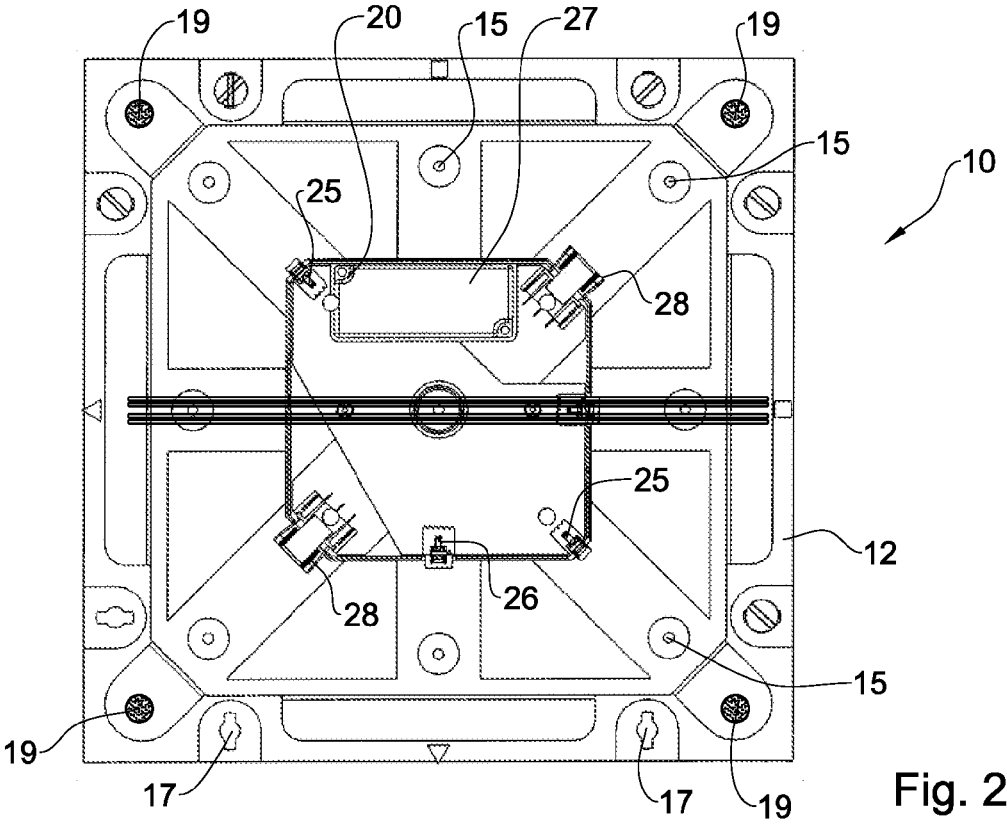
FIG. 2A illustrates a schematic front view of a base unit of the light tile shown in FIG. 1.
Figure 2B:
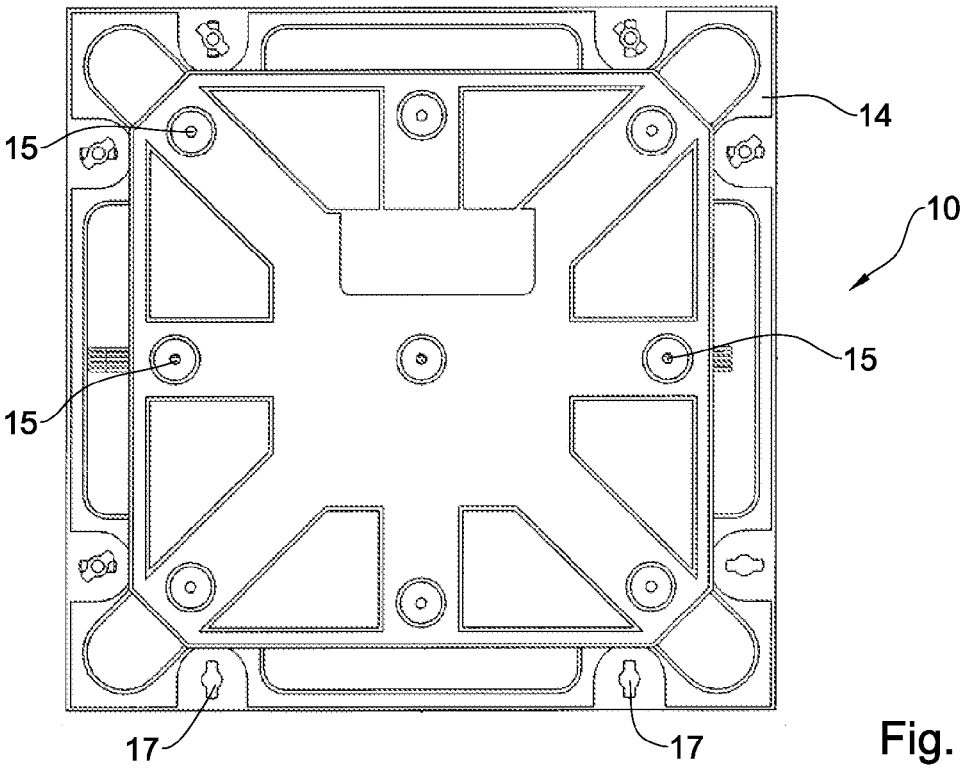
FIG. 2B illustrates a schematic rear view of the base unit shown in FIG. 1.
Figure 2C:
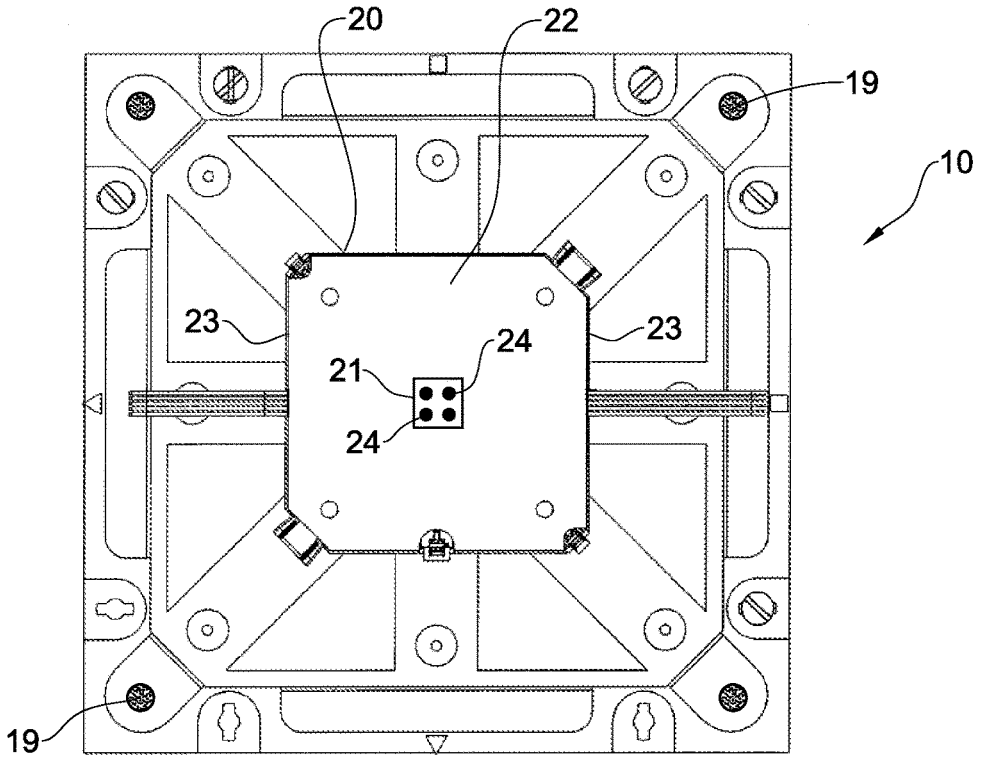
FIG. 2C illustrates the base unit of FIG. 2A with a covering of an electric unit thereof.

Referring to FIG. 5 and to FIG. 2A, the electric unit 20 has a power supply 27, and a power source connector 26 configured for connecting the power supply 27 with an external power source (not shown), for supplying electric power of 110 or 220 Volt to the electric unit 20. The electric unit 20 additionally includes two joining power connectors 28, each of which can be used for connecting the electric unit 20 with another electric unit 20 so as to provide and share power supply therebetween. This connection and sharing is shown in FIG. 5, in which a cable 29 electrically interconnects the electric units 20 of two base units 10.

The electric unit 20 can further include a controller connector 25 configured for connecting the electric unit 20 with an external controller responsible for controlling the operation of the light sources 35 of the light-source bed 30. The controller connector 25 can also be used for connecting the electric unit 20 of one light tile with a corresponding controller connector 25 of an electric unit of another light tile for controlling the operation of the light sources of both electric units.

The base unit 10 has a mounting arrangement in form of holes 15 which are configured for connecting the rear face 14 to a supporting element (not shown). The supporting element can be, for example a wall, a ceiling or any other structural element.

The light tile 100 can further comprise a cover 50 (shown in FIG. 4), which is mountable on the light-source bed 30 for protecting the light sources 35 and for decorative purposes. The cover 50 can have different types of structure and design. For example, the cover 50 can be colored, transparent, semi-transparent, opaque, etc. The cover 50 is mountable on the front face 31 of the light-source bed 30 by a snapping mechanism.

As shown in FIG. 1, the base unit 10, the light-source bed 30 and the cover 50 are mountable to each other, so as to form an assembled light tile 100. While the base unit 10 is mounted to a supporting element, the light-source bed 30 and the cover 50 can be replaced with other light-source bed 30 and cover 50. This replacement does not require replacing the whole light tile 100 or the base unit 10 thereof. The light-source bed that replaces the original light-source bed can have snapping elements 32, second magnetic elements 39, and a bed electric connector 34 similar to those of the original light source bed, but the light sources of the other light-source bed may have a different arrangement patter and type, and the other light-source bed or the other cover 50 can have a different shape and design.

Figure 6:
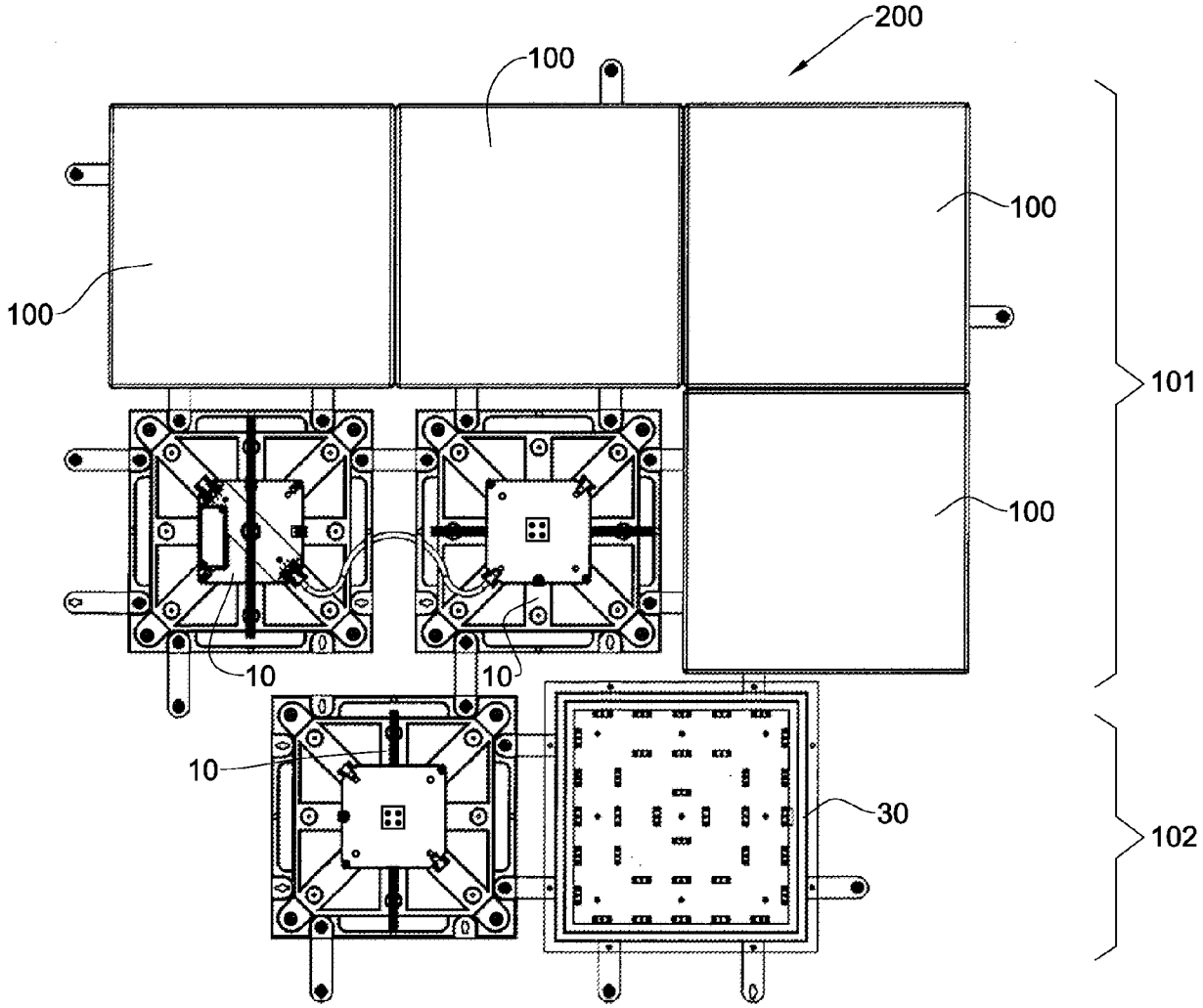
FIG. 6 illustrates a schematic front view of a modular light system, partially exposed, according to one example of the presently disclosed subject matter.

Reference is now made to FIG. 6, which schematically illustrates an example of modular light system 200 comprising a plurality of light tiles 100. The base units 10 of the system 200 are mechanically connected between each other so as to form an array of base units. This figure illustrates different light tiles, parts of which are fully assembled and other parts of which are presented with a removed light-source bed and/or cover.

In general, the modular light system 200 allows using the array of base units 10 for mounting thereon different corresponding light source beds according to various requirements and needs, and replacing the light source beds according to these requirements and needs, whilst keeping the structure of the array. In other words, while the array of base units 10 is permanently connected to a supporting element (e.g., a wall), the light source beds and their corresponding covers can be replaced without change the structure of the array.

In addition to the ability of replacing the light source beds of a particular base unit, the modular light system 200 allows adding or removing the base units by connecting and disconnecting them to and from each other, thereby defining the amount of light tiles forming the array of base units 10. This array can have a shape and a size according to various design needs.

The ability to define the amount of base units forming the array, and the ability to mount different light source beds on each of the base units and replace them according the various needs, provide the modular light system 200 with freedom and flexibility to form various light structures according to various design and other needs.

According to the example of FIG. 6, the modular light system 200 includes two groups of light tiles: a first group 101 and a second group 102. Each one of the groups 101 and 102 includes light tiles which are connected to each other a non-shifted manner. This means the each two corners of two base units are proximal to each other. On the other hand, the first group 101 is disposed in a shifted manner with respect to the second group 102. According to this disposition, a corner of a base unit from the first group 101 is disposed in the middle of a rim of a base unit from the second group 102.

According to a specific example, one of the light tiles of the modular light system 200 can be used as a main light tile having a main base unit. This means that the main base unit will be connected to the power source, and to the controller, and that the rest of the base units are electrically connected thereto. According to a specific example, the main base unit includes an internal controller that controls the operation of the main base unit, and other base units of the modular light system. The internal controller has an IR receiver that communicates by IR signals with a remote control and receives instructions therefrom.

Figure 7A:
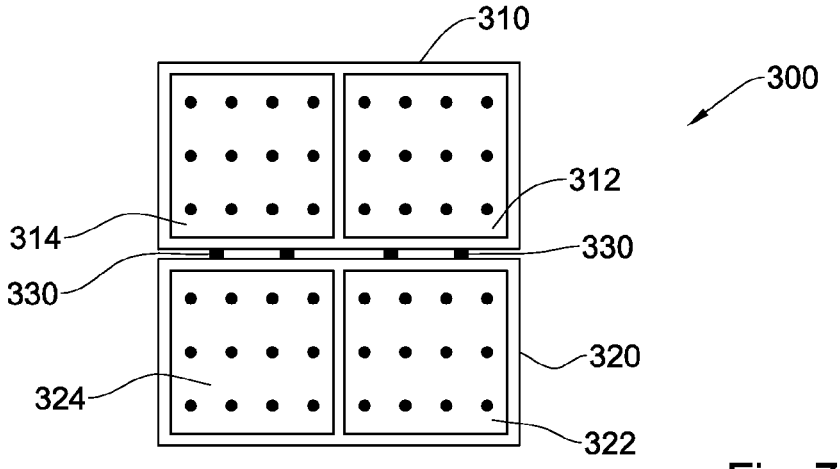
FIG. 7A illustrates a schematic example of a modular light system according to the presently disclosed subject matter.

FIG. 7A illustrates a schematic example of a modular light system 300 having two base units 310 and 320, and of which has two light-source beds. The modular light system 300 is shown without covers in front of the light source beds. The base unit 310 has a first light-source bed 312 and a second light-source bed 314 mounted thereto, and disposed in proximity to each other. The base unit 320 has a third light-source bed 322 and a fourth light-source bed 324 mounted thereto, and disposed in proximity to each other. The base unit 310 and 320 are connected to each other by an interconnecting arrangement 330.

Figure 7B:
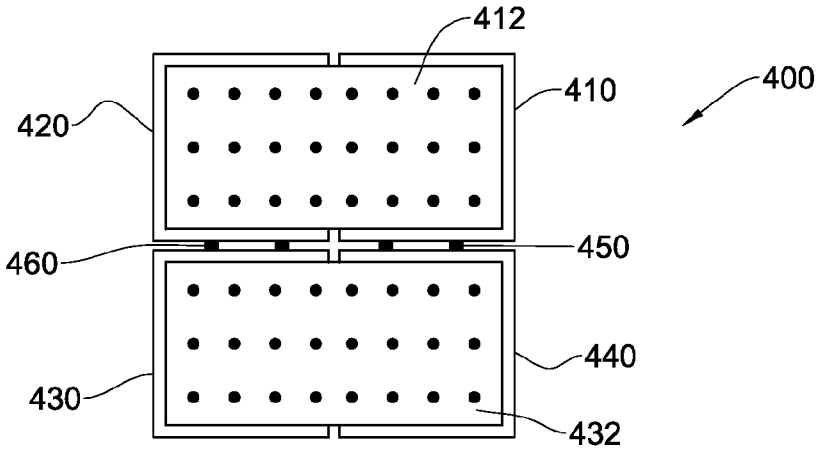
FIG. 7B illustrates another schematic example of a modular light system, according to the presently disclosed subject matter.

FIG. 7B illustrates a schematic example of a modular light system 400 having four base units 410, 420, 430 and 440. The base units 410 and 420 have a common first light-source bed 412 mounted thereto, and the base units 430 and 440 have a common second light-source bed 432 mounted thereto. The modular light system 400 is shown without covers in front of the light source beds. The base unit 410, 420, 430 and 440 are connected to each other by interconnecting arrangements, of which two interconnecting arrangements 450 and 460 are shown.

Figure 7C:
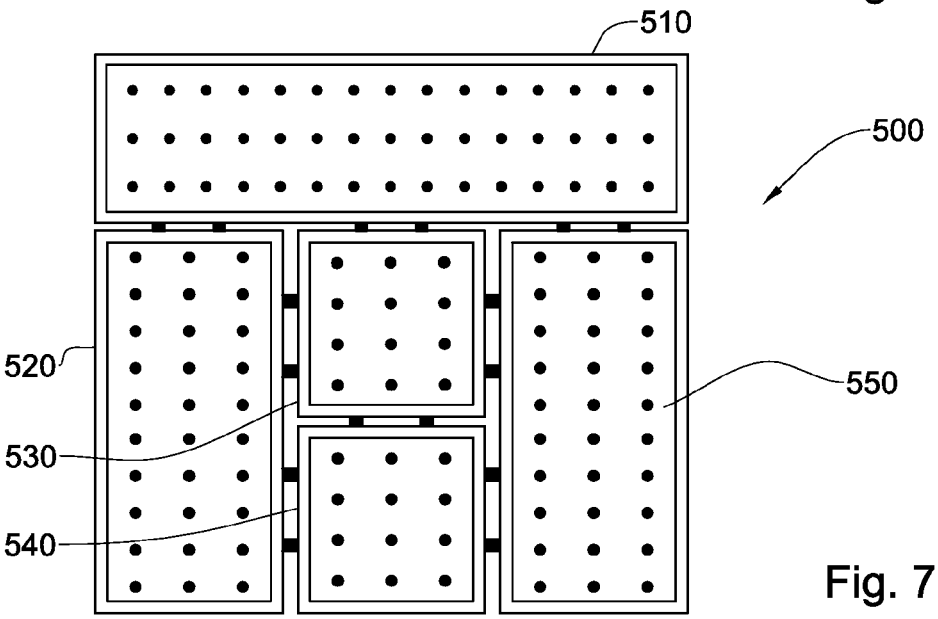
FIG. 7C illustrates another schematic example of a modular light system, according to the presently disclosed subject matter.

FIG. 7C illustrates an example of a modular light system 500 in which each of the light tiles has a size different from at least one of its neighboring light tiles. According to this example, the modular light system 500 has light tiles with a modularly increasing size so that each light tile has a neighboring light tile with a double size than its size. The modular light system 500 has five light tiles 510, 520, 530, 540 and 550. The light tiles 520 and 550 have a size that is double than the size of the light tiles 530 and 540. In addition, the light tile 510 has a size that is three time larger than the size of the light tiles 530 and 540.

Whilst in the drawings of the present application present a light tiles with a rectangular shape, it is appreciated that this is a mere example and any other shape, and combinations of shapes can be used for establishing an array of a modular light system according to the present disclosure.

The invention claimed is:

1. A light tile, comprising:

a light-source bed having a rear face and a front face, the front face accommodating at least one light source; and a base unit having a rear face and a front face, the base unit comprising a housing integral with the base unit, an interconnecting arrangement for interconnecting the base unit with base units of two or more other light tiles, the front face of the base unit being configured for interfacing with the rear face of the light-source bed by at least one detachable mechanical connector so as to establish detachable mechanical connection therebetween, wherein the front face of the light source bed and the front face of the base unit, face towards an area to be illuminated by the at least one light source, and the rear face of the light source bed and the rear face of the base unit, face away from the area to be illuminated by the at least one light source, the housing comprising an electric unit that is configured to be electrically connected with the light-source bed so as to establish electric communication therebetween and to provide electric power to the at least one light source, said electric unit comprising a power supply for supplying power to the electric unit, two joining power connectors, each configured for connecting the electric unit with an electric unit of a base unit of one of said other light tiles, so as to provide and share power supply therebetween, an internal controller responsible for receiving operational instructions and controlling the operation of the at least one light source, and two controller connectors each configured for connecting the electric unit with an external controller responsible for controlling the operation of the at least one light source or with a corresponding controller connector of one of said other light tiles, so as to allow a shared control of the electric units.

2. The light tile according to claim 1, further comprising a cover configured to extend along the front face of the light-source bed for at least partially covering the at least one light source.

3. The light tile according to claim 1, wherein the at least one detachable mechanical connector comprises, at the base unit, at least one base unit mechanical connector, and at the light-source bed, at least one corresponding bed mechanical connector configured to be mechanically connected with the at least one base unit mechanical connector so as to establish the mechanical connection between the base unit and the light-source bed.

4. The light tile according to claim 3, wherein the base unit mechanical connector is disposed at the front face of the base unit, and the bed mechanical connector is disposed at the rear face of the light-source bed.

5. The light tile according to claim 3, wherein the base unit mechanical connector and the bed mechanical connector are magnetic elements configured for magnetically attracting to each other.

6. The light tile according to claim 3, wherein the base unit mechanical connector is a snapping element and the bed mechanical connector is a corresponding receiving element configured to engage with the snapping element.

7. The light tile according to claim 1, wherein the electric unit comprises a base unit electric connector and the light-source bed comprises a corresponding bed electric connector configured to be electrically connected with the base unit electric connector so as to establish the electric communication between the base unit and the light-source bed to provide electric power to the at least one light source.

8. The light tile according to claim 7, wherein the electric communication between the base unit electric connector and the bed electric connector is configured to be automatically provided upon establishment of the mechanical connection between the base unit and the light-source bed.

9. A modular light system comprising a plurality of light tiles according to claim 1.

10. The modular light system according to claim 9, wherein each of the light tiles further comprises a cover configured to extend along the front face of the light-source bed for at least partially covering the at least one light source.

11. The modular light system according to claim 9, wherein the at least one detachable mechanical connector comprises, at the base unit, at least one base unit mechanical connector, and at the light-source bed, at least one corresponding bed mechanical connector configured to be mechanically connected with the at least one base unit mechanical connector so as to establish the mechanical connection between the base unit and the light-source bed.

12. The modular light system according to claim 11, wherein the base unit mechanical connector is disposed at the front face of the base unit, and the bed mechanical connector is disposed at the rear face of the light-source bed.

13. The modular light system according to claim 11, wherein the base unit mechanical connector and the bed mechanical connector are magnetic elements configured for magnetically attracting to each other.

14. The modular light system according to claim 11, wherein the base unit mechanical connector is a snapping element and the bed mechanical connector is a corresponding receiving element configured to engage with the snapping element.

15. The modular light system according to claim 9, wherein the electric unit comprises a base unit electric connector and the light-source bed comprises a corresponding bed electric connector configured to be electrically connected with the base unit electric connector so as to establish the electric communication between the base unit and the light-source bed to provide electric power to the at least one light source.

16. The light tile according to claim 1, wherein the housing extends outwardly from the front face of the base unit.

* * * * *